United States Patent [19]

Beny

[11] Patent Number: 4,471,564

[45] Date of Patent: Sep. 18, 1984

[54] VISCOUS POWER MOTOR FOR EQUIPMENT

[76] Inventor: Janos Beny, 23775 Madison St., Torrance, Calif. 90505

[21] Appl. No.: 318,826

[22] Filed: Nov. 6, 1981

Related U.S. Application Data

[63] Continuation-in-part of Ser. No. 128,679, Mar. 10, 1980, abandoned.

[51] Int. Cl.[3] ..... A63H 33/30

[52] U.S. Cl. ..... 446/486; 74/526; 74/97; 188/268; 446/425; 446/428

[58] Field of Search ..... 46/39, 40, 206, 201, 46/214, 219; 188/268, 290; 16/54, 51, 82, 291, DIG. 10; 73/430, 496, 522; 192/58 R, 58 A; 185/37; 200/33 R, 39 R, 36, 67 R, 67 B, 67 E, 67 PK; 74/526, 519, 97, 523

[56] References Cited

U.S. PATENT DOCUMENTS

| | | | |
|---|---|---|---|
| 2,766,849 | 10/1956 | Rudiger | 185/37 |
| 2,891,274 | 6/1959 | Bloom | 16/291 |
| 3,118,167 | 1/1964 | Morris et al. | 16/54 X |
| 3,145,056 | 8/1964 | Blahnik | 46/214 X |
| 3,305,063 | 2/1967 | Theilen | 16/291 X |
| 3,619,939 | 2/1969 | Vidal | 46/201 |
| 3,633,535 | 1/1972 | Puster | 73/430 |

*Primary Examiner*—Mickey Yu
*Attorney, Agent, or Firm*—Herzig, Schaap & Yanny

[57] ABSTRACT

A spring driven power device in which energy in a loaded spring is delivered to a rotary member. A hollow cylindrical member having a splined inside surface is provided. A stem with external splines is coaxially mounted within the hollow cylindrical member with a space between the members. A viscous material such as silicon putty is disposed in the annular space between the members. A driving spring is provided which can be a coil tension spring with connections from the spring to one of the members, preferably the hollow cylindrical member. Relative rotation between the members is resisted by the viscous material. The spring releases its energy driving the hollow cylindrical member in a manner such that the energy is released in a steady controlled manner.

4 Claims, 9 Drawing Figures

Fig. 6
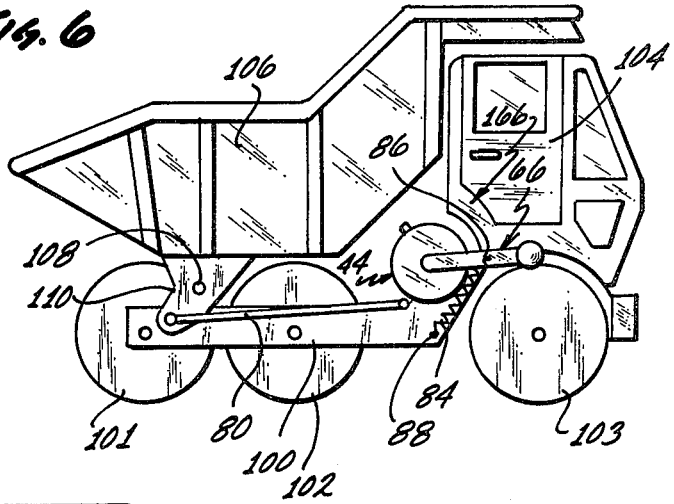
Fig. 7
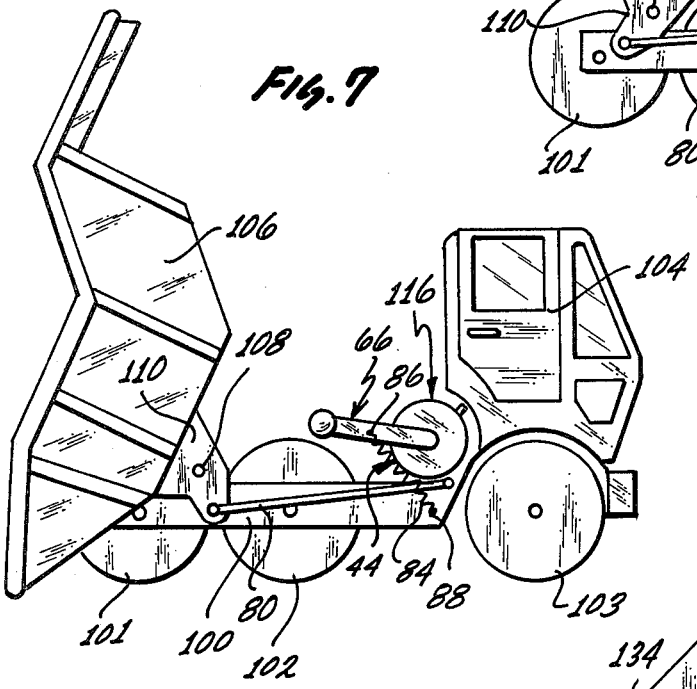
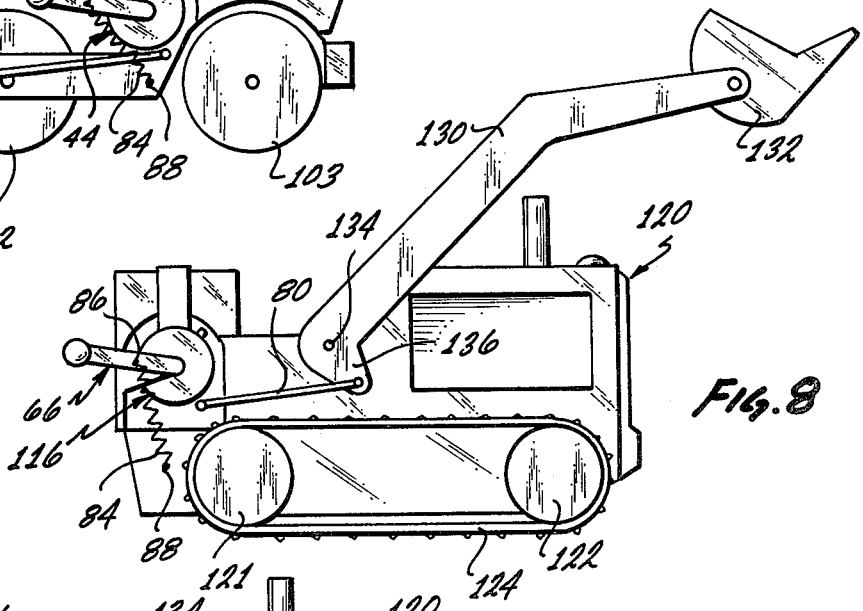
Fig. 8
Fig. 9
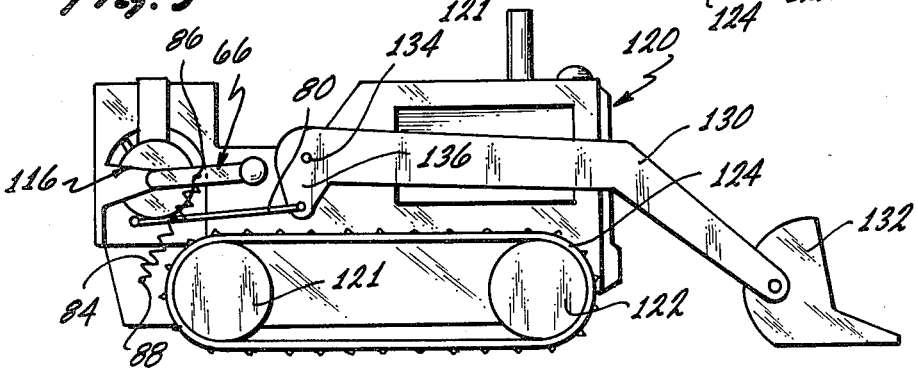

VISCOUS POWER MOTOR FOR EQUIPMENT

This application is a continuation-in-part of U.S. Ser. No. 06/128,679, filed 03/10/80 now abandoned.

BACKGROUND OF THE INVENTION

1. Field of the Invention

The field of the invention is that of motors or power devices and more particularly such a device which is powered simply by a spring. The field of the invention is concerned primarily with simplified driving devices to be used in toys, but is not necessarily limited in that respect.

2. Description of the Prior Art

Many different types of motors and driving devices are, of course, known in the prior art. In the field of toys spring motors and electric motors are well known as driving devices. What has not been available in the prior art, particularly for utilization in toys has been a simplified driving device, in which the power can be supplied by an ordinary coil spring. More particularly, what has not been available has been such a device so constructed that the power and energy in the spring can be released at a slow steady state simulating a power source of relatively great power such as might be employed in heavy equipment or otherwise. The herein invention fills this need that exists in the prior art, a preferred exemplary form of the invention being described in detail hereinafter.

SUMMARY OF THE INVENTION

In a preferred exemplary form of the invention it is constructed so as to be particularly adapted for use in toys for purposes of driving the toy or for operating driven parts or components of the toy. The invention, however, is not limited to this type of utilization. As examples of toys having power operated components in which the invention may be utilized are mentioned cranes, bulldozers, dump trucks, skip loaders, fork lifts, tow trucks, and many other related implements.

In the preferred exemplary form of the invention two relatively rotatable parts are provided, preferably an outside part in the form of a hollow cylinder, with the second in the form of a central stem with an annular space in between the parts. The parts are concentrically mounted for relative rotation, although preferably the stem is fixed. The interior surface of the hollow cylindrical is splined and the exterior surface of the stem is splined, and in the space between the splines is provided a viscous material, which may for example be silicon putty or other comparable viscous material. When the hollow cylindrical part is rotated relative to the stem part the rotation is resisted by the viscous material. A spring is provided with connections to one of the parts, preferably the hollow cylindrical part for rotating it, rotation of this part being resisted by the viscous material. The energy in the spring is delivered to the part in a relatively slow steady manner, so that the device provides a power source that simulates a powerful drive motor or similar source.

Preferably the spring is an over center spring connected to a lever concentrically mounted with the other parts, there being means providing for interengagement between the lever and the hollow cylinder. The power from the device can be taken off and utilized in various ways. The device is particularly adapted for use for example in operating a dump truck, power shovel, or similar pieces of equipment.

In the light of the foregoing, the primary object of the invention is to make available a simplified spring actuated power device capable of causing the energy in a spring to be released in a slow, steady manner so as to provide a strong but steady power output.

A further object is to realize a device as in the foregoing embodying cylindrical members with a viscous material between them arranged so that relative rotation is resisted by the viscous material, with a spring arrangement for rotating one of the cylindrical members relative to the other to provide a steady but strong rotary drive.

A further object is to realize a device as in the foregoing wherein the device is driven by an ordinary over center spring which actuates a lever concentrically mounted with the cylindrical part with means providing interengagement, so that one of the cylindrical members is driven relatively through the lever.

Further objects and additional advantages will become apparent from the following detailed description and annexed drawings.

DESCRIPTION OF A PREFERRED EMBODIMENT AND THE BEST MODE OF PRACTICE

Figure 1:
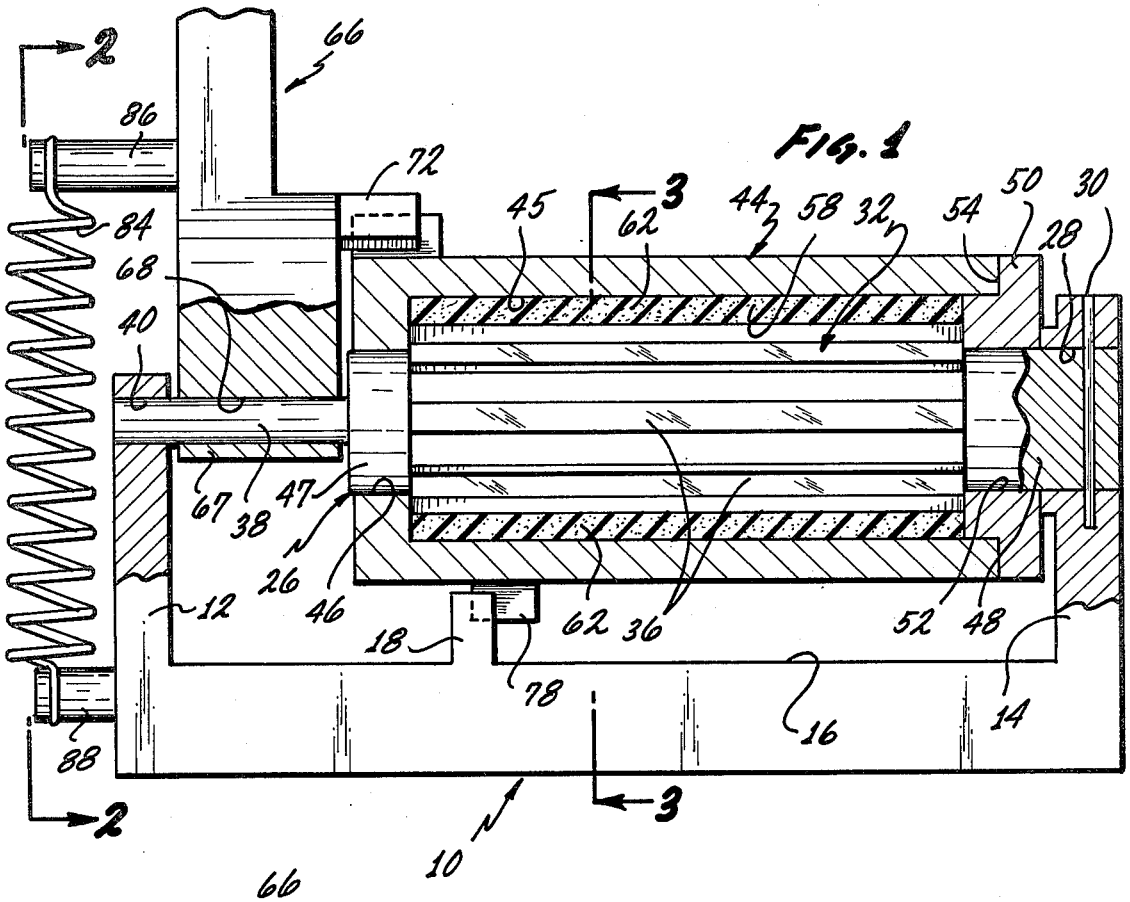
FIG. 1 is a sectional view of a preferred form of the invention.
Figure 2:
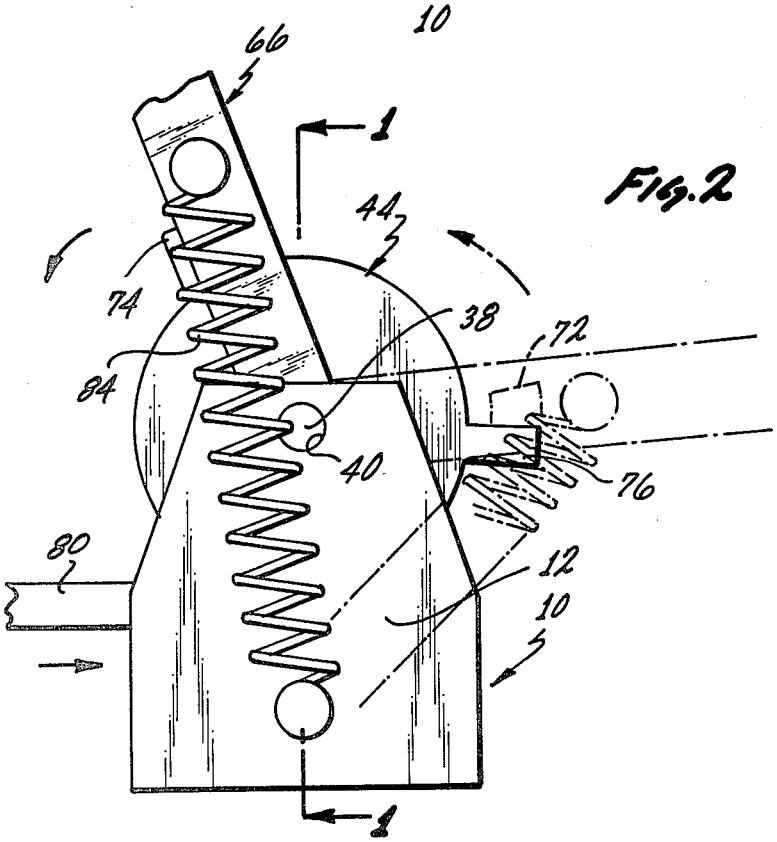
FIG. 2 is an end view taken along line 2—2 of FIG. 1.
Figure 3:
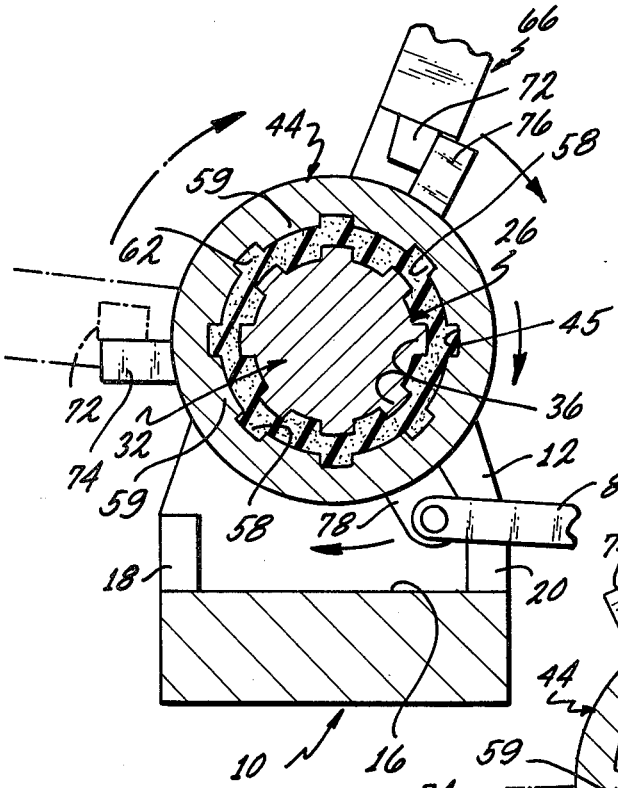
FIG. 3 is a sectional view taken along the line 3—3 of FIG. 1, showing the device with the hollow cylinder in a position at one of the end stops.
Figure 4:
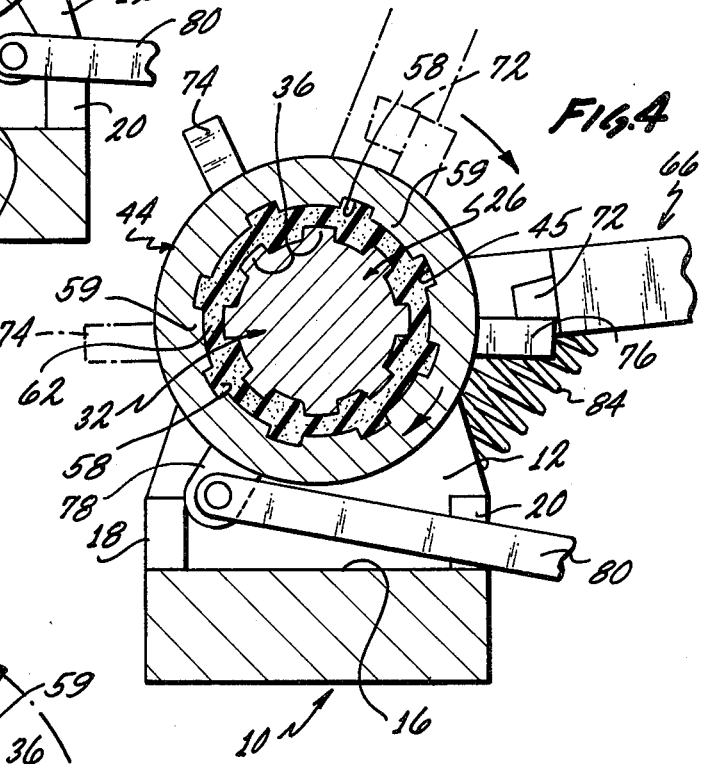
FIG. 4 is a sectional view like that of FIG. 3 with the hollow cylinder in the other end stop position.
Figure 5:
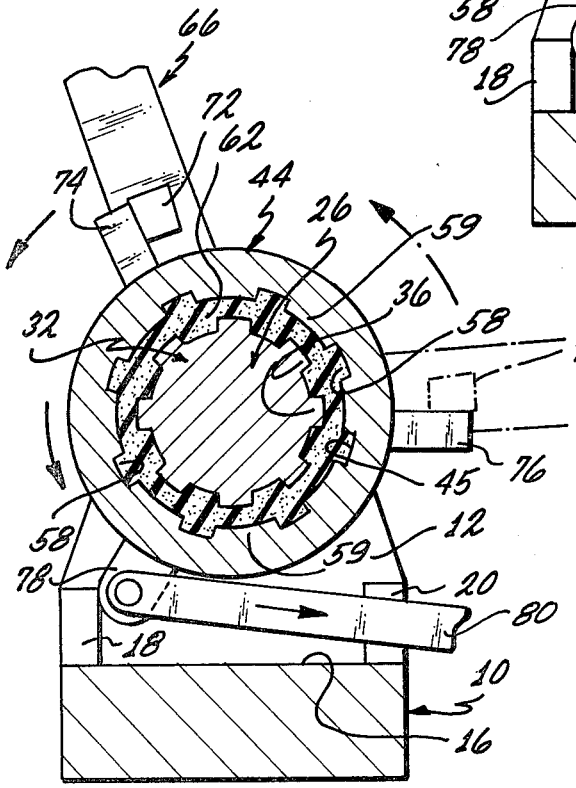
FIG. 5 is a view like that of FIGS. 3 and 4, showing the parts in position ready for driving movement in a counter clockwise direction.

FIGS. 1 and 2 illustrates a preferred form of the device, with its operation illustrated in FIGS. 3, 4, and 5.

Numeral 10 designates a base frame having upright end parts 12 and 14. The frame has a cavity in it as designated at 16, providing sides as designated at 18 and 20. Numeral 26 designates a cylinder or stem member, one end of which is journalled in an opening 28 in the end 14 of frame 10. Numeral 30 designates a pin extending through the end of the cylinder 26, so that it is held against rotation. The cylinder or stem member 26 has an enlarged part 32 spaced from the ends and this part has axial splines as designated at 36 in FIG. 3 with axial grooves between the splines.

The member 26 has an extending stem 38 the end of which is journalled in a bore 40 in the end part 12 of the frame 10.

Numeral 44 designates a hollow cylinder having a bore 45 and having end counter-bore 46 in which is journalled an end part 47 of the cylinder or stem 26. Numeral 50 designates an end fitting having a bore 52 in which the end part 48 of the member 26 is journalled. The fitting 50 on the left side has a square annular shoulder 54 in which is received the end of the cylindrical member 44.

The member 44 has internal axial grooves as designated at 58, so that splines 59 are formed between the grooves.

Provided in the annular space between the stem member 26 and the cylindrical member 44, is a viscous material as designated at 62, which may be silicon putty or other comparable viscous material.

Numeral 66 designates a lever having an enlarged lower part 67, having a bore 68 which is journalled on the stem 38, extending from the member 26. Thus the member 26, 44 and 66 are co-axially mounted.

The lever 66 has an extending lug as designated at 72. The cylinder 44 has two angularly spaced radial lugs as designated at 74 and 76. These lugs are preferably about 90° apart.

The cylinder 44 has another extending lug 78, at a position that may be seen in FIG. 3, and pivotally attached to it is an operating link 80. The lug 78 operates between stop members 18 and 20 which are side parts of the frame 10.

Numeral 84 designates a coil tension spring. One end of the spring is attached to a pin 86 extending from the lever 66. The other end of the spring is attached to a pin 88 extending from the frame 10, as shown in FIGS. 1 and 2.

The device as described provides a driving motor, or source of power having a unique characteristic as will appear. The operation is illustrated in FIGS. 3, 4, and 5. In FIG. 3 the lug 78 on the cylinder 44 is against the limit stop 20 on the right as shown. The lugs 74 and 76 on the cylinder 44 are in the position as appears in FIG. 3. The lever 66 is in a position as shown with its lug 72 engaging the lug 76 on the cylinder 44. At this time the lever 66 is in an over center position with respect to the spring 84, as may be seen in FIG. 2. In this position the device is ready to drive in a clockwise direction from the position of FIG. 3 to that of FIG. 4. The energy in the spring produces the driving movement. Rotation of the cylinder 44 is resisted by the viscous material in the annular space between cylinder 44 and the stem member 26. There is a steady controlled release of the energy in the spring as the lever 66 moves from the position of FIG. 4. The developed power can be utilized in any desired way. The cylinder 44 moves clockwise until the lug 78 engages the left hand limit stop as shown in FIG. 4.

In FIG. 5 the lever 66 has been manually moved from the position as shown in FIG. 4 to a position in which the lug 72 on the lever engages the lug 74 on the cylinder 44. The spring 84 has been manually moved over center in a counter-clockwise direction looking at FIG. 5. The device is now in a position to drive in a counter-clockwise direction rotating the cylinder until the lug 78 is moved back into the position as shown in FIG. 3. Again the energy of the spring is released in a steady controlled manner, which simulates the effect of a powerful driving motor, the drive being imparted to link 80.

The motor or driving device as described can be utilized in a number of different ways which are unique because of the manner in which the energy of the spring is released and the power available. FIGS. 6 and 7 illustrate utilization of the invention in a toy dump truck. These figures show a dump truck having a chassis frame 100 with wheels as shown at 101, 102, and 103. The truck has a cab as designated at 104. It has a dump body or a material holder as designated at 106. This body is pivotally mounted on a transverse shaft 108, which extends through brackets one of which is designated by the numeral 110. A driving device or motor corresponding to that as shown in FIGS. 1-5 and designated by the numeral 116 is mounted on the truck chassis in a position to the rear of the cab.

In FIG. 6 the part 44 and the lever 66 are in a clockwise rotated position with the dump body 106, in its normal travelling position. In order to effect the dumping action, the lever 66 is mannually turned in counter-clockwise direction to an over center position relative to the spring 84. The spring then continues to drive the lever 66 and the cylinder 44 in a counter-clockwise direction into a position as shown in FIG. 7, the rotation of the cylinder 44 acting through the link 80 attached to the brackets 110 causes the dump body to be rotated in a counter-clockwise direction into a dumping position as illustrated in FIG. 7. In this operation the driving motor operates just as described in connection with FIGS. 1-5.

FIGS. 8 and 9 illustrate another example of utilization of the invention in a toy. In this case the toy is in the form of power shovel mounted on a caterpillar type tractor. The tractor is designated by the numeral 120, having wheels as designated at 121 and 122 and having driving belt treads on of which is designed at 124.

Pivotally mounted on the tractor is a shovel arm 130, carrying shovel 132 and the arm 130 being pivotally mounted on a transverse shaft 134 carried by the tractor. The arm 130 has an extending bracket 136 to which the link 80 is connected, the other end of the link being attached to the cylinder 44 as previously described. The motor 116 is mounted on the chassis as shown by way of brackets as shown at 125.

FIG. 8 shows the arm 130 and the shovel 132 in a lifted position. In this position the lever 66 has been rotated in a counter-clockwise direction moving the spring 84 over center with the lever 66 coming into engagement with the lug 74 on the cylinder 44. The spring 84 has produced continuous driving movement in a counter-clockwise direction with the link 80 exerting thrust against the bracket 136, so as to rotate the arm 130 around its pivot 134 in a counter-clockwise direction into a position as shown.

In FIG. 9 the lever 66 has been moved in a clockwise direction so that its lug 72 has been brought into engagement with the lug 76 on the cylinder 44. The spring 84 has produced continued rotation in a clockwise direction causing a pull to be exerted by the link 80 on the bracket 136, of arm 130 so that the arm and shovel 132 are moved back into the position of FIG. 9.

From the foregoing those skilled in the art will understand the nature and construction of the invention and its manner of utilization. The driving motor is of extremely simplified construction with the energy being derived simply from an ordinary spring, which can be simply a coil tension spring. The invention is highly adaptable as shown for use in powering the different types of toy vehicles or components of such vehicles, although, its utilization is not limited thereto. The embodiments as disclosed illustrate a manner of taking off the power from the device, although it might be taken off in other ways.

The foregoing disclosure is representative of the preferred forms of the invention and is to be interpreted in an illustrative rather than a limiting sense, the invention to be accorded the full scope of the claims appended hereto.

I claim:

1. As an article of manufacture, in combination, a hollow cylindrical first member, a cylindrical stem second member within the hollow cylindrical member, there being an annular space in between the members, the said members being mounted concentrically about a common axis, a viscous material contained in the space between the first and second members, the hollow cylindrical member having an irregular inner surface and the said stem member having an irregular external surface, whereby the viscous material resists relative motion as between the members, at least one of the said members being mounted so as to be rotatable, an element mounted to be manually rotatable about the aforesaid axis, a spring means connected to said element and mounted to cause rotation of the element and means providing for an engagement of the element with the said member that is rotatable, whereby the viscous material resists rotation of the last said member and said element, whereby the energy of the spring means is delivered to the said member in a steady controlled manner, said spring means being an over-center spring mounted to drive said element when the said element is moved over the center of the spring, said element being rotatable independently of the said rotatable member through the over-center position.

2. An article as in claim 1 wherein said means providing engagement includes interengaging lugs on said rotatable member and on said element, whereby the said element can rotate said rotatable member in either clockwise or counter-clockwise direction.

3. An article as in claim 1 wherein said first member has axial grooves on the interior surface thereof and said stem member has axial grooves on the exterior thereof, there being splines between grooves.

4. An article as in claim 1 including a toy having a base part, and a pivoted working part simulating a power driven part, the said members and the said element being mounted on the said base part and the said rotatable member having a connection to said pivoted working part for driving it.

* * * * *